United States Patent [19]

Vuaille

[11] 3,960,127

[45] June 1, 1976

[54] DEVICE FOR REGULATING THE DELIVERY OF A FUEL INJECTION PUMP OF AN INTERNAL COMBUSTION ENGINE

[75] Inventor: Andre Vuaille, Lyon, France

[73] Assignee: Sigma Diesel, Uenissieux, France

[22] Filed: Oct. 29, 1974

[21] Appl. No.: 519,013

[30] Foreign Application Priority Data

Oct. 30, 1973 France ..... 73.38636

[52] U.S. Cl. ..... 123/140 MP; 123/140 R; 123/140 FG

[51] Int. Cl.[2] ..... F02D 1/04; F02D 1/06

[58] Field of Search.... 123/140 FG, 140 R, 140 MP

[56] References Cited

UNITED STATES PATENTS

| | | | |
|---|---|---|---|
| 3,477,418 | 11/1969 | Roosa | 123/140 R |
| 3,698,369 | 10/1972 | Vuaille | 123/140 FG |

FOREIGN PATENTS OR APPLICATIONS

| | | | |
|---|---|---|---|
| 1,084,574 | 6/1960 | Germany | 123/140 FG |
| 1,884,514 | 4/1962 | Germany | 123/140 FG |

*Primary Examiner*—Charles J. Myhre
*Assistant Examiner*—Ronald B. Cox
*Attorney, Agent, or Firm*—Larson, Taylor & Hinds

[57] ABSTRACT

A device for regulating the delivery of a fuel injection pump of an internal combustion engine comprises a centrifugal governor coupled to a regulating member of the pump by a transmission lever so that the delivery of the pump is regulated in dependence upon engine speed. The transmission lever is pivotally connected at its ends to a control member of the governor and to the regulating member respectively, the lever being freely rotatably mounted intermediate its ends on a spindle eccentrically mounted on a pivot rotatably supported by a casing of the device. Actuating means responsive to a controlling fluid pressure is provided for rotating the pivot in order to adjust the regulating member in dependence upon the controlling fluid pressure. The actuating means comprises a differential piston received in a cylinder to define first and second permanently interconnected chambers, the first chamber of smaller cross-section being supplied with working fluid and the second chamber of greater cross-section communicating with a low pressure region via a variable throttle section defined between the differential piston and a pilot valve whose position is adjusted by a deformable unit sensitive to the controlling fluid pressure.

7 Claims, 3 Drawing Figures

DEVICE FOR REGULATING THE DELIVERY OF A FUEL INJECTION PUMP OF AN INTERNAL COMBUSTION ENGINE

BACKGROUND OF THE INVENTION

This invention relates to a device for regulating the delivery of a fuel injection pump of an internal combustion engine.

In particular, the invention concerns such a regulating device of the kind which comprises: a control member movable in dependence upon the speed of the engine; a regulating member for adjusting the delivery of the injection pump; a transmission lever for transmitting movement of said control member to said regulating member, said transmission lever having its ends pivotally connected to said control member and said regulating member respectively; a casing housing said control member, said regulating member and said transmission lever; a pivot having a geometric axis, said pivot being mounted on said casing for rotation about said geometric axis; a spindle connected to said pivot for rotation with said pivot, said spindle being parallel to and eccentric with respect to the geometric axis of said pivot, said transmission lever being freely rotatably mounted on said spindle intermediate the ends of said transmission lever; and actuating means sensitive to a controlling fluid pressure for rotating said pivot, thereby to move said regulating member to adjust the delivery of the injection pump in response to changes in said controlling fluid pressure.

Devices of this kind are known and are disclosed, for example, in U.S. Patent Application No. 362,360 filed 21st May 1973. The eccentricity of the transmission lever-bearing spindle in relation to the pivot enables the injection pump delivery or rate of flow to be corrected in dependence upon the controlling fluid pressure, particularly at full load. This correction is generally effected in dependence on the atmospheric pressure or on a supercharging air pressure, such supercharging air being delivered to the engine by a compressor or a turbo-compressor driven by said engine.

The prior-art devices have disadvantages, however, particularly in as much as they have relatively long response times and relatively low sensitivity.

SUMMARY OF THE INVENTION

The main object of the invention is to provide a device of the aforesaid kind which satisfies practical requirements more satisfactorily and, in particular, does not have the above disadvantages.

According to the invention, a device of the aforesaid kind for regulating the delivery of an injection pump of an internal combustion engine is characterized in that said actuating means comprise: a differential piston having first and second working surfaces with said first surface of smaller area than said second surface; a cylinder receiving said differential piston and defining with said first and second surfaces of said piston respective first and second chambers with said first chamber of smaller cross-sectional area than said second chamber; said first and second chambers being permanently connected together by a linking duct of small cross-section, said cylinder having an inlet for introducing working fluid to said first chamber; a pilot valve defining with said differential piston a viariable throttle section connecting said second chamber to a low pressure region into which said working fluid is discharged; and a deformable unit sensitive to said controlling fluid pressure and operatively coupled to said pilot valve to adjust the position of said pilot valve in response to changes in said controlling fluid pressure.

Preferably, the linking duct connecting said first and second chambers of the cylinder together extends through said piston between said first and second surfaces of said piston.

Advantageously, the transmission lever is directly articulated on the regulating member which is of the rack type.

Again preferably, said piston of said actuating means undergoes linear movement in said cylinder, and coupling means are operatively connected between said piston and said pivot to convert linear movement of said piston into rotary movement of said pivot.

Advantageously, said piston is movable in a direction orthogonal to the axis of the said pivot, and said coupling means between said piston and said pivot comprise an operating plate lying perpendicular to the axis of said pivot and keyed to said pivot for movement therewith, and a connecting member mounted, e.g. by screwing, on the end of said differential piston, said operating plate being forked to define a slot and said connecting member comprising a finger adapted to cooperate with said slot in said operating plate.

The deformable unit controlling the pilot valve is conveniently of the barometric capsule type and is constituted by a resilient metal diaphragm or bellows inside which a vacuum has been produced.

Advantageously, the servo-motor pilot valve is directly fixed, e.g. by welding, on said metal diaphragm.

In an embodiment, said differential piston comprises an axial bore having one end receiving said pilot valve and the other end in communication with said low pressure region, said pilot valve comprising a longitudinal blind bore opening into said bore of said piston and a cylindrical surface formed with at least one orifice communicating with said blind bore and co-operating with the interior surface of said bore in said piston to form said variable throttle section.

The barometric capsule may be disposed in an enclosure at relatively zero pressure, in which case the correction of the pump delivery is effected in dependence on atmospheric pressure, or in an enclosure at the pressure of the supercharging air delivered to the engine.

The working fluid used for the differential piston and cylinder is generally oil under pressure.

BRIEF DESCRIPTION OF THE DRAWINGS

In order that the invention may be readily understood, embodiments thereof will now be described, by way of example, with reference to the appended drawings, in which.

DESCRIPTION OF PREFERRED EMBODIMENTS

Figure 2:
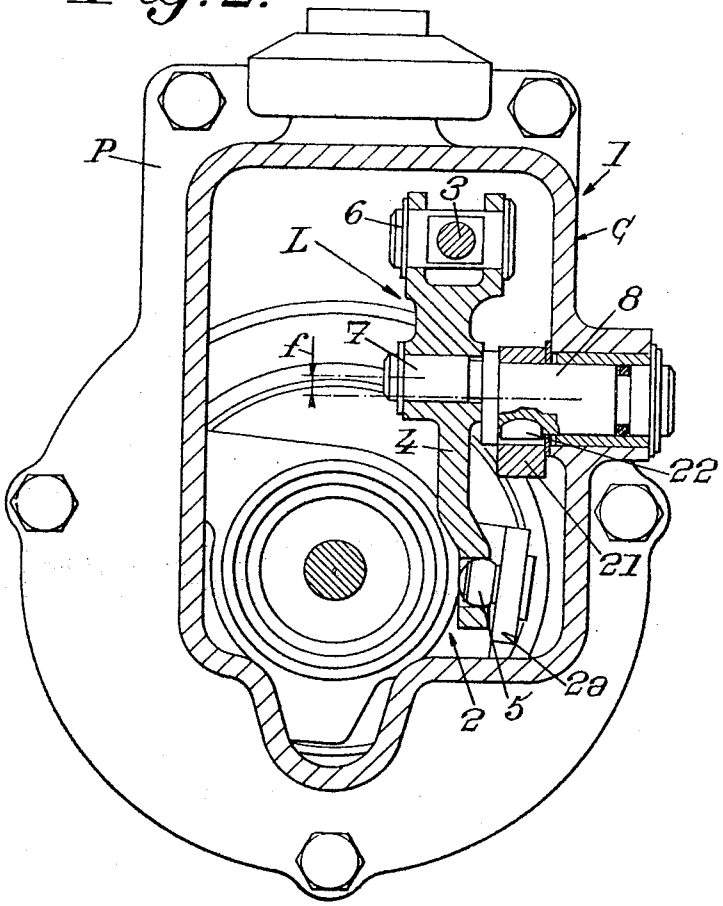
FIG. 2 is a section on the line II—II in FIG. 1.
Figure 1:
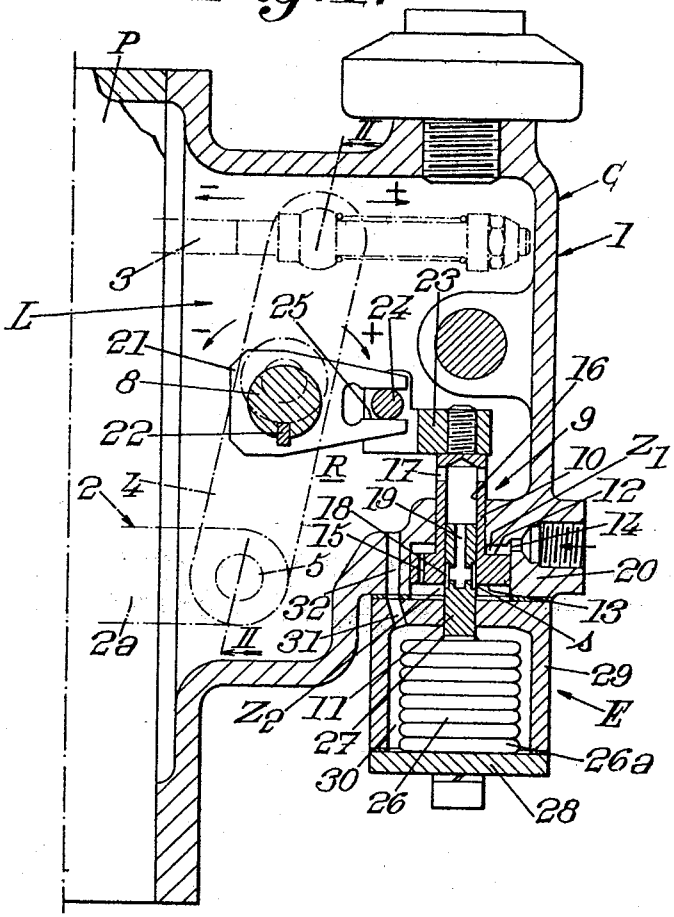
FIG. 1 of the drawings is a partial axial section showing a regulating device according to the invention.

Referring to the drawing, and more particularly FIGS. 1 and 2, a regulating device 1 is provided for controlling the delivery or rate of flow of fuel per revolution of a fuel injection pump P which is shown diagrammatically. The device 1 comprises means 2 for controlling the adjustment of the delivery of the pump P, said control means 2 generally comprising a centrifugal governor responsive to the speed of rotation of an internal combustion engine fed by the pump P. The device also comprises a regulating member 3 for regulating the delivery of the pump and such regulating member generally comprises a conventional rack or rod adapted to slide along its longitudinal axis. Movement of the rack 3 to the right in FIG. 1 increases the delivery of the pump as shown by the arrow with the plus sign above it while movement of the rack 3 in the opposite direction reduces the rate of flow per revolution as indicated by the arrow with the minus sign above it.

The device 1 also comprises connecting means L between the control means 2 and the regulating member 3, said connecting means L comprising a transmission lever 4 connected pivotally at its ends to the control means 2 and the rack 3 respectively.

According to the embodiment shown in the drawings, the lever 4 is articulated at its one end on a swivel joint 5 borne by a longitudinal arm or control member 2*a* of the control means 2 and adapted to be moved longitudinally in dependence upon the speed of the engine. The other end of the lever 4 is articulated directly on a pivot 6 connected to the rack 3 for translatory movement. In other embodiments of the device, the lever 4 could be connected to the arm 2*a* and/or to the rack 3 through the agency of additional levers.

The transmission lever 4 is mounted, between its ends and between the swivel joint 5 and the pivot 6, so as to be freely rotatable on a spindle 7 connected to a pivot 8 borne by a casing C of the device 1. The geometric axis of the spindle 7 is parallel to and eccentric with respect to the geometric axis of the pivot 8. This eccentricity is denoted by reference *f* in FIG. 2. Preferably, spindle 7 is equidistant from the ends of the lever 4.

Fluid pressure sensitive actuating means E for rotating the pivot 8 in dependence upon a controlling fluid pressure are provided, and such actuating means E comprise a follow-up servomotor 9 having a differential piston 10 and a pilot valve 11 which together with the piston is adapted to define a variable throttle section *s* depending upon the relative position of the valve and the piston.

The term "differential piston" 10 denotes a piston having a first working surface 12 of small area and a second working surface 13 of larger area, said surfaces being subject to a working fluid pressure. The surfaces 12 and 13 respectively define a first or small-section chamber $Z_1$ and a second or large-section chamber $Z_2$ in a cylinder 20 in which the piston 10 moves.

The chambers $Z_1$ and $Z_2$ are permanently connected to one another via a linking duct 15 of small cross-section; said duct 15 is preferably provided in the piston 10 as shown in the drawings and extends through the piston between the surfaces 12 and 13.

Fluid inlet means constituted by an orifice 14 are provided to introduce working fluid i.e. oil into the small-section chamber $Z_1$.

The large-section chamber $Z_2$ communicates via the variable throttle section *s* with a region R in which the working oil for the servomotor 9 is contained under low pressure, more particularly at relatively zero pressure.

The differential piston 10 comprises an axial bore 16, one end of which is adapted to receive the pilot valve while the other end communicates with region R. According to the example shown in the drawing, the bore 16 is blind at its said other end and communicates with the region R via radially directed orifices 17. The cylindrical outer surface of the pilot valve 11 comprises at least one, and preferably two, orifices 18 adapted to cooperate with the inner surface of the bore 16 to form the variable throttle section *s*.

The orifices 18 communicate with a longitudinal blind duct 19 formed in the valve 11 and opening into the bore 16 adjacent the orifices 17.

The axis of the servo-motor 9 is orthogonal to the geometric axis of the pivot 8 and the cylinder 20 in which the head of the piston 10 undergoes linear movement is formed by a part of the casing C of the regulating device.

A forked operating plate 21, the contour of which is visible in FIG. 1, is secured by means of a key 22 to the pivot 8 for rotation with the pivot 8, the central plane of said operating plate 21 being perpendicular to the axis of pivot 8. Operating plate 21 enables rotation of the pivot 8 to be effected. Clockwise rotation of the pivot with respect to FIG. 1 corresponds to an increase in the pump delivery as indicated by the arrows; rotation in the opposite direction corresponds to a reduction of pump delivery.

A connecting member 23 mounted directly, by being screwed, on the end of the piston rod 10 is provided and comprises a finger 24 adapted to cooperate with a slot 25 formed in the operating plate 21.

The servo-motor 9 is controlled by a deformable unit 26, the movements of the pilot valve 11 being controlled by said unit.

The unit 26 is advantageously of the barometric capsule type and comprises a resilient metal diaphragm in the form of a bellows as will be apparent from FIG. 1, the interior of the capsule having been evacuated.

The pilot valve 11 is secured directly on the movable end of said metal diaphragm 26, more particularly by welding at 27. The other end 26*a* of the diaphragm 26 is held against a wall 28 which is fixed with respect to the casing C of the regulating device.

The capsule 26 is disposed in a cylinder 29 forming an enclosure 30 closed at one end by the wall 28. Cylinder 29 is fixed on the casing of the regulating device.

According to the embodiment shown in FIG. 1, the enclosure 30 is connected by ducts 31 and 32, respectively provided in the cylinder wall 29 and in the casing, to the region R at relatively zero pressure, i.e., at atmospheric pressure. In this case, the capsule 26 is subjected to atmospheric pressure and will control the position of the pilot valve 11 in response to variations in atmospheric pressure.

Figure 3:
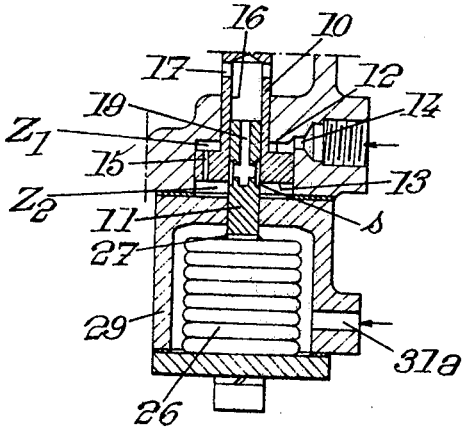
FIG. 3 is a detail of a modified form of the device according to FIG. 1.

According to the modification shown in FIG. 3, the cylinder 29 comprises a spigot 31*a* adapted to be connected to an inlet for supercharging air delivered to the engine, so that the capsule 26 will be externally subjected to the supercharging air pressure. The position of the pilot valve 11 will then be controlled in dependence on the value of the pressure of the supercharging air which is delivered by a compressor or by a turbocompressor driven by the engine.

The regulating device operates as follows:

As regards the servo-motor 9, any movement of the pilot valve 11 is followed by the piston 10. Referring to FIG. 1 and assuming that the valve 11 moves upwards so as to completely close the throttle section *s*, the pressure in the second chamber $Z_2$ bounded by the second surface 13 of the differential piston 10 will increase and ultimately become equal to the fluid pressure arriving at inlet 14. Since the area of the surface 13 is larger than that of the surface 12, the piston 10 will tend to move upwardly, i.e., in the same direction as the valve 11. Conversely, if the pilot valve 11 tends to descend and increase the throttle section *s*, the rate of flow of oil to the low-pressure region R from the chamber $Z_2$ will increase so that the pressure loss occurring in the small duct 15 will also increase. The first surface 12 of the piston head 10 will therefore be subjected to a greater pressure than the second surface 13, and for a given throttle section *s* the pressure effect will predominate so that the piston 10 will descend with the pilot valve 11.

Under these conditions, with the embodiment according to FIG. 1, when atmospheric pressure drops the capsule 26 elongates and causes the pilot valve 11 to move upwards so that the piston 10 moves in the same direction. Rotation of the forked operating plate 21 is effected in the anti-clockwise direction and with it the movement of the spindle 7 which results in a reduction of the pump delivery. A correction in the opposite direction is brought about when atmospheric pressure increases.

In the case of a supercharged engine (see FIG. 3), when the supercharging air pressure increases, the capsule 26 contracts, the valve 11 and the piston 10 descend and the regulating member 3 is moved in the direction to increase the pump delivery.

The present invention reduces the response times involved in the operation of the device, particularly as a result of using a follow-up servo-motor in which the pilot valve and the piston are continually in motion, and it is possible to use a barometric capsule which is very sensitive to pressure variations.

Of course the follow-up servo-motor could be different from that described with reference to the drawings. The servo-motor could, for example, be of the type shown in FIGS. 1 to 3 of Applicants' French Pat. No. 2,071,528 filed 31st Dec. 1969 (National Registration No. 69,45,752), i.e., the linking duct permanently connecting the chambers $Z_1$ and $Z_2$ could be provided in the cylinder wall 20.

I claim:

1. A device for regulating the delivery of a fuel injection pump of an internal combustion engine, comprising:

a control member movable in dependence upon the speed of the engine;

a regulating member for adjusting the delivery of the injection pump;

a transmission lever for transmitting movement of said control member to said regulating member, said transmission lever having its ends pivotally connected to said control member and said regulating member respectively;

a casing housing said control member, said regulating member and said transmission lever;

a pivot having a geometric axis, said pivot being mounted on said casing for rotation about said geometric axis;

a spindle connected to said pivot for rotation with said pivot, said spindle being parallel to and eccentric with respect to the geometric axis of said pivot, said transmission lever being freely rotatably mounted on said spindle intermediate the ends of said transmission lever; and actuating means sensitive to a controlling fluid pressure for rotating said pivot, thereby to move said regulating member to adjust the delivery of the injection pump in response to changes in said controlling fluid pressure;

in which device said actuating means comprise:

a differential piston having first and second working surfaces with said first surface of smaller area than said second surface;

a cylinder receiving said differential piston and defining with said first and second surfaces of said piston respective first and second chambers with said first chamber of smaller cross-sectional area than said second chamber, said first and second chambers being permanently connected together by a linking duct of small cross-section, said cylinder having an inlet for introducing working fluid to said first chamber;

a pilot valve defining with said differential piston a variable throttle section for connecting said second chamber to a low pressure region into which said working fluid is discharged; and a deformable unit comprising a resilient metal bellows having an evacuated interior and sensitive to said controlling fluid pressure and operatively coupled to said pilot valve such that said pilot valve is rigidly and directly fixed on said deformable unit so as to adjust the position of said pilot valve in response to changes in said controlling fluid pressure, said differential piston comprising an axial bore having one end receiving said pilot valve and the other end provided with orifices in communication with said low pressure region, said pilot valve comprising a longitudinal blind bore opening into said axial bore adjacent to said orifices of said other end, said pilot valve comprising a cylindrical surface formed with at least one orifice communicating with said axial bore in said piston to form said variable throttle section.

2. A device as claimed in claim 1, wherein said linking duct connecting said first and second chambers extends through said differential piston between said first and second working surfaces.

3. A device as claimed in claim 1, wherein said transmission lever is directly articulated on said regulating member.

4. A device as claimed in claim 1, wherein said differential piston is linearly movable in said cylinder and coupling means are operatively connected between said piston and said pivot to convert linear movement of said piston into rotary movement of said pivot.

5. A device as claimed in claim 1, wherein said metal bellows is disposed in an enclosure at atmospheric pressure, so that atmospheric pressure constitutes said controlling fluid pressure.

6. A device as claimed in claim 1 for a supercharged engine supplied with supercharging air, in which device said metal bellows is disposed in an enclosure to which said supercharging air is admitted, so that the pressure of said supercharging air constitutes said controlling fluid pressure.

7. A device for regulating the delivery of a fuel injection pump of an internal combustion engine, comprising: a control member movable in dependence upon the speed of the engine: a regulating member for adjusting the delivery of the injection pump; a transmission lever for transmitting movement of said control member to said regulating member, said transmission lever having its ends pivotally connected to said control member and said regulating member respectively; a casing housing said control member, said regulating member and said transmission lever; a pivot having a geometric axis, said pivot being mounted on said casing for rotation about said geometric axis; a spindle connected to said pivot for rotation with said pivot, said spindle being parallel to and eccentric with respect to the geometric axis of said pivot, said transmission lever being freely rotatably mounted on said spindle intermediate the ends of said transmission lever; and actuating means sensitive to a controlling fluid pressure for rotating said pivot, thereby to move said regulating member to adjust the delivery of the injection pump in response to changes in said controlling fluid pressure; in which device said actuating means comprise: a differential piston having first and second working surfaces with said first surface of smaller area than said second surface; a cylinder receiving said differential piston and defining with said first and second surfaces of said piston respective first and second chambers with said first chamber of smaller cross-sectional area than said second chamber, said first and second chambers being permanently connected together by a linking duct of small cross-section, said cylinder having an inlet for introducing working fluid to said first chamber; a pilot valve defining with said differential piston a variable throttle section for connecting said second chamber to a low pressure region into which said working fluid is discharged; and a deformable unit sensitive to said controlling fluid pressure and operatively coupled to said pilot valve to adjust the position of said pilot valve in response to changes in said controlling fluid pressure; said differential piston being linearly movable in said cylinder, coupling means operatively connected between said piston and said pivot to convert linear movement of said piston into rotary movement of said pivot, said piston being movable in a direction orthogonal to the axis of said pivot, said coupling means comprising an operating plate lying perpendicular to the axis of said pivot and keyed to said pivot for movement therewith and a connecting member mounted on the end of said differential piston, said operating plates being forked to define a slot and said connecting member having a finger cooperating with said slot in said operating plate.

* * * * *